United States Patent [19]

Igoe

[11] Patent Number: 4,814,251

[45] Date of Patent: Mar. 21, 1989

[54] LIQUID DEVELOPER COMPOSITIONS

[75] Inventor: Steven E. Igoe, Columbus, Ohio

[73] Assignee: Xerox Corporation, Stamford, Conn.

[21] Appl. No.: 115,009

[22] Filed: Oct. 29, 1987

[51] Int. Cl.[4] ..... G03G 9/12

[52] U.S. Cl. ..... 430/115; 430/114; 430/137

[58] Field of Search ..... 430/114, 115, 137

[56] References Cited

U.S. PATENT DOCUMENTS

| | | | |
|---|---|---|---|
| 3,968,044 | 7/1976 | Tamai et al. | 430/114 X |
| 3,986,968 | 10/1976 | Damai et al. | 430/137 X |
| 4,005,022 | 1/1977 | Vijayendran | 430/114 |
| 4,104,183 | 8/1978 | Tsubuko et al. | 430/114 |
| 4,181,620 | 1/1980 | Tsubuko | 430/114 |
| 4,241,159 | 12/1980 | Priem et al. | 430/114 |
| 4,374,918 | 2/1983 | Veillette et al. | 430/115 |
| 4,473,629 | 9/1984 | Herrmann et al. | 430/114 |
| 4,599,291 | 7/1986 | Podszün et al. | 430/114 |
| 4,624,544 | 11/1986 | Jeromin | 355/3 R |
| 4,663,265 | 5/1987 | Uytterhoeven et al. | 430/114 |

FOREIGN PATENT DOCUMENTS

| | | | |
|---|---|---|---|
| 1940985 | 3/1971 | Fed. Rep. of Germany . | |
| 2105929 | 8/1971 | Fed. Rep. of Germany | 430/115 |
| 1374701 | 11/1974 | United Kingdom . | |

*Primary Examiner*—Roland E. Martin

*Attorney, Agent, or Firm*—Judith L. Byorick

[57] ABSTRACT

Disclosed is a xeroradiographic liquid developer composition comprising an isoparaffinic hydrocarbon, a pigment, a first polymeric resin component comprising a vinyl toluene acrylic terpolymer resin, and a second polymeric resin component comprising an acrylic copolymer resin.

68 Claims, No Drawings

LIQUID DEVELOPER COMPOSITIONS

BACKGROUND OF THE INVENTION

The present invention is directed to liquid electrophotographic developer compositions. More specifically, the present invention is directed to a liquid developer with high sensitivity that is suitable for use in electrophotographic devices such as those that perform xeroradiographic medical imaging. One embodiment of the present invention resides in a liquid electrophotographic developer composition comprising an isoparaffinic hydrocarbon, a pigment, a first polymeric resin component comprising a vinyl toluene acrylic terpolymer resin, and a second polymeric resin component comprising an acrylic copolymer resin.

The formation and development of images on the surface of photoconductive materials by electrostatic means is well known. For example, U.S. Pat. No. 2,297,691 discloses an electrophotographic imaging process that entails placing a uniform electrostatic charge on a photoconductive insulating layer, such as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. The toner will normally be attracted to those areas of the photoreceptor which retain a charge thereby forming a toner image corresponding to the electrostatic latent image. This developed image may then be transferred to a substrate such as paper and subsequently be permanently affixed to the substrate.

For the electrophotographic process, either dry or liquid developers may be used for development of the electrostatic latent image. Liquid developers generally comprise insulating carrier liquids in which pigments or dyes, resins, charge controllers, and possibly other additives are dispersed or dissolved. In the electric field of the charge image, the charged toner particles are deposited electrophoretically on the charge image.

Various liquid electrophotographic developers are known. For example, U.S. Pat. No. 4,473,629 discloses a liquid developer containing negatively charged toner particles for developing electrostatic charge images comprising a carrier liquid having a high electrical resistivity and a low dielectric constant, such as the aliphatic hydrocarbons commercially available as Isopar ®E, G, H, K, or L, a pigment or dye constituent, a resinous binder, a charge controller, and conventional additives, wherein the pigment or dye constituent is dispersed in a solution of styrene/butadiene copolymer binder in the carrier liquid. This patent also discloses a process for preparing the liquid developer.

Also, U.S. Pat. No. 4,374,918, discloses a thermally stable liquid negative developer comprising an organic liquid carrier such as the aliphatic hydrocarbon Isopar ®G, a pigment, a stabilizing gel on the borderline of solubility in the carrier, a latex which imparts a fixative function to the developer, and a two component charge control agent. According to this patent, the charge control agent consists of a first polymer, soluble in the carrier, having a basic character because of the inclusion of pyrrolidone or hydroxylated alkyl groups; and a second polymer, insoluble or on the borderline of solubility in the carrier, having an acid character because of the inclusion of free halogenated groups, and containing a minor amount of carrier soluble moieties. The two components may constitute separate ingredients, or either or both components may be incorporated into the structure of other developer components.

German Laid-Open Patent Application No. 1,940,985 discloses a liquid electrostatic developer comprising toner particles dispersed in an insulating liquid. The toner particles are aggregates, the outside of which are connected with a binder or fixing resin such as Pliolite ®VT without being completely surrounded or coated by the resin, said aggregates being less than one thousand angstroms.

The liquid suspension developer disclosed in U.S. Pat. No. 4,599,291 comprises an electrically insulating carrier liquid, a pigment, and a block copolymer comprising blocks of vinyl aromatic compounds such as polystyrene and blocks of dienes, such as polybutadiene that have been partially or completely reacted with alkyl mercaptans. The block copolymer is applied to the pigment by melting or precipitation, and metal salts of long-chained organic acids may be present as charge control agents.

Another liquid developer disclosed in U.S. Pat. No. 4,241,159 comprises an insulating carrier liquid with a low dielectric constant, such as the aliphatic hydrocarbons commercially available as Isopar ®G, H, K, and L, in which is dispersed resin-precoated toner particles formed of a pigment or coloring agent precoated with a homopolymer or copolymer of an acrylic or methacrylic acid ester of hydrogenated abietyl alcohol. In addition, the liquid developer may contain other polymeric binding agents to adjust viscosity or to act as charge fixing agents, such as a copolymer of isobutyl methacrylate and stearyl methacrylate comprising about 0.2 percent of methacrylic acid, sold under the trade name Neocryl ®B 702.

Although the above mentioned liquid electrophotographic developers are suitable for their intended purposes, a need continues to exist for high sensitivity electrophotographic liquid developers. A need also exists for liquid developers suitable for use in xeroradiographic medical imaging devices such as the Xerox ®175 System, or those dislcosed in U.S. Pat. No. 4,624,544, the disclosure of which is totally incorporated herein by reference. Also, a need continues to exist for liquid developers that enable formation of medical diagnostic images of high resolution. In addition, a need exists for liquid developers with sufficient sensitivity to enable formation of high resolution medical diagnostic xeroradiographic images while exposing the patient to low doses of radiation. Further, a need exists for high sensitivity liquid developers that are also electrostatically transferrable, such that transfer of the developed image from the photoreceptor to the substrate may be achieved without disruption of the image.

SUMMARY OF THE INVENTION

It is an object of the present invention to provide a high sensitivity electrophotographic liquid developer having the above noted advantages.

It is another object of the present invention to provide a liquid developer suitable for use in xeroradiographic medical imaging devices.

Another object of the present invention is to provide a liquid developer that enables formation of medical diagnostic images of high resolution.

A further object of the present invention resides in the provision of a liquid developer with sufficient sensitivityto enable formation of high resolution medical diagnostic xeroradiographic images while exposing the patient to low doses of radiation.

Yet another object of the present invention resides in the provision of a high sensitivity liquid developer composition that is also electrostatically transferrable, such that transfer of the developed image from the photoreceptor to the substrate may be achieved without disruption of the image.

Another object of the present invention is to provide a process for preparing a high sensitivity electrophotographic liquid developer.

It is an additional object of the present invention to provide a process for using a high sensitivity electrophotographic liquid developer that enables formation of medical diagnostic images of high resolution.

These and other objects of the invention are achieved by providing a liquid developer composition for use in xeroradiographic imaging systems, comprising: (a) an isoparaffinic hydrocarbon; and (b) a concentrated solution comprising (i) said isoparaffinic hydrocarbon, present in an amount of from about 60 to about 80 percent by weight; (ii) a pigment present in an amount of from about 10 to about 18 percent by weight; (iii) a first polymeric resin component comprising a vinyl toluene acrylic terpolymer resin present in an amount of from about 3 to about 7 percent by weight; and (iv) a second polymeric resin component comprising an acrylic copolymer resin present in an amount of from about 5 to about 20 percent by weight, wherein said paraffinic hydrocarbon is present in an amount sufficient to provide a developer solution, which comprises from about 98.0 to about 99.5 percent by weight of said isoparaffinic hydrocarbon. The developer composition has an extremely high sensitivity, which translates into an extremely low charge to mass ratio of from about 3 to about 10 microcoulombs per gram. A low charge to mass ratio results in the development of more toner particles, which in turn enables formation of high resolution images from latent images formed on a photoreceptor by exposure to extremely small amounts of X-ray radiation, such as 0.05 to 0.15 rads.

The developer of the present invention may be prepared by: (a) preparing a concentrated solution by (i) introducing into a container tumbling media and a composition comprising from about 60 to about 80 percent by weight of an isoparaffinic hydrocarbon, from about 10 to about 18 percent by weight of a pigment, from about 3 to about 7 percent by weight of a first polymeric resin component comprising a vinyl toluene acrylic terpolymer resin, from about 5 to about 20 percent by weight of a second polymeric resin component comprising an acrylic copolymer resin, and from about 0.01 to about 0.05 percent by weight of an antioxidant additive; (ii) placing the container on a rolling mill; and (iii) tumbling the container on the rolling mill at a rate of from about 180 to about 240 feet per minute for a period of from about 40 to about 65 hours; and (b) adding to the concentrated solution an additional amount of the isoparaffinic hydrocarbon, such that a developer solution comprising from about 98.0 to about 99.5 percent by weight of the isoparaffinic hydrocarbon results.

The isoparaffinic hydrocarbon present in the liquid developer composition functions as a dispersing liquid. This liquid preferably has a flash point of from about 38° to about 41° C. (100° to 105° F.), although the flash point may be as high as 125° F. It is preferred that the dispersing liquid have a flash point within the range of 100° to 125° F. to enhance drying time, transfer, and image quality. Preferred dispersing liquids are Isopar®G and Isopar®H, available from Exxon Co., Houston, TX, or Shell Sol®70, available from Shell Oil Company. The dispersing liquid will preferably have a specific gravity of from about 0.74 to about 0.76 gram per milliliter at about 15.6° C.

The developer composition of the present invention comprises a concentrated developer solution that is diluted with an additional amount of the isoparaffinic hydrocarbon dispersing liquid. Within the concentrated solution, the dispersing liquid is present in an amount of from about 60 to about 80 percent by weight, and preferably about 70 percent by weight. To this concentrated solution is added an additional amount of the dispersing liquid, such that the resulting developer solution contains from about 98.0 to about 99.5 percent by weight of the isoparaffinic hydrocarbon, and preferably 99.5 percent by weight. When used in operation in an imaging device, the concentrated solution and the additional dispersing liquid may be kept separate until both components of the developer are placed into the imaging apparatus. Machines such as the Xerox®175 are equipped such that the mixing of the concentrate with the additional liquid dispersant occurs after the concentrate has been installed in the apparatus.

Preferably, the developer of the present invention contains an added antioxidant preservative to increase shelf life and prevent decomposition. Suitable additives include butylated hydroxytoluene (BHT), such as Shell Ionol CP, available from McKesson Chemical Co., Los Angeles, CA, butylated hydroxyanisole (BHA), tertiary butyl hydroquinone (TBHQ), or propyl gallate (PG). The antioxidant additive should be of a type that does not interfere with the electrical, physical, or mechanical properties of the developer disclosed herein. The antioxidant additive is present in the concentrated solution in an amount of from about 0.01 to about 0.05 percent by weight of the concentrated solution, and preferably 0.03 percent by weight.

The developer of the present invention also includes a pigment such as a carbon black pigment. A preferred pigment is Black Toner BK 8595, available from Paul Uhlich & Co., Hastings-on-Hudson, NY, which is a specially treated carbon black material characterized in that it is molybdated, and in that it has a dye adsorbed onto the carbon black to impart a blacker appearance to the pigment. Preferably, the pigment provides a negative AMES test and has a polyaromatic hydrocarbon content of no more than one part per million. In addition, the pigment should be compatible with the other components of the liquid developer of the present invention, such that the developer composition possesses the electrical, physical, and chemical properties disclosed herein. The pigment may be present in an amount of from about 10 to about 18 percent by weight of the concentrated solution, and preferably 15 percent by weight.

Also contained in the liquid developer of the present invention are two resin components. The first resin comprises a vinyl toluene acrylic terpolymer resin, such as Pliolite®OMS resin, manufactured by Goodyear Co., Akron, OH. The first resin may have a conductance of from about 10,000 to about 20,000 picomhos, and preferably from about 12,000 to about 16,000 picomhos, as measured in a solution of about 10 percent by weight of the solid resin, and about 90 percent by weight of a solvent such as Isopar ®G. These values are equivalent to a specific conductivity of from about $1.58\times10^{-9}$ to about $3.16\times10^{-9}$(ohm-cm)$^{-1}$, preferably from about $1.90\times10^{-9}$ to about $2.53\times10^{-9}$(ohm-cm)$^{-1}$, since for the measurement procedure described, 100 picomhos$=1.58\times10^{-11}$(ohm-cm)$^{-1}$. This first resin component may be present in an amount of from about 3 to about 7 percent by weight of the concentrated solution, and preferably about 5.5 percent by weight.

The second resin comprises an acrylic copolymer resin, such as Neocryl ®S-1004, available from Polyvinyl Chemical Industries, Wilmington, MA. Preferably, the second resin has a conductance of from about 25 to about 100 picomhos, and preferably about 65 picomhos measured in a solution of about 10 percent by weight of the solid resin and about 90 percent by weight of a solvent such as Isopar ®G, or a specific conductivity of from about $3.95\times10^{-12}$ to about $1.58\times10^{-11}$(ohm-cm)$^{-1}$, and preferably about $1.03\times10^{-1}$(ohm-cm)$^{-1}$. This second resin component may be present in an amount of from about 5 to about 20 percent by weight of the concentrated solution, and preferably about 9 percent by weight.

Another aspect of the present invention resides in a process for preparing the liquid developer described herein. One embodiment of the invention constitutes a process comprising the steps of: (a) preparing a concentrated solution by (i) introducing into a container tumbling media and a composition comprising from about 60 to about 80 percent by weight of an isoparaffinic hydrocarbon, from about 10 to about 18 percent by weight of a pigment, from about 3 to about 7 percent by weight of a first polymeric resin component comprising a vinyl toluene acrylic terpolymer resin, from about 5 to about 20 percent by weight of a second polymeric resin component comprising an acrylic copolymer resin, and from about 0.01 to about 0.05 percent by weight of an antioxidant additive; (ii) placing the container on a rolling mill; and (iii) tumbling the container on the rolling mill at a rate of from about 180 to about 240 feet per minute for a period of from about 40 to about 65 hours; and (b) adding to the concentrated developer solution an additional amount of the isoparaffinic hydrocarbon, such that a developer composition comprising from about 98.0 to about 99.5 percent by weight of the isoparaffinic hydrocarbon results.

The concentrated solution for the liquid developer of the present invention is prepared by introducing the above mentioned components into a container such as a three gallon ceramic jar in which are contained tumbling media such as Burundum cylinders, steel shots, stainless steel balls, normandy pebbles, or ceramic balls. Preferred tumbling media are Burundum cylinders of one half inch height and one half inch diameter, available from Diamonite Products Manufacturing, Inc., Shrieve, OH. The container is placed on a rolling mill and tumbled at a rate of from about 180 to about 240 feet per minute, and preferably about 210 feet per minute, for a period of from about 40 to about 65 hours. The milling process should continue until the concentrated solution has the properties and characteristics set forth below; if it does not, tumbling should be continued and subsequent measurements performed until all of the properties and characteristics discussed below are within the desired ranges.

Subsequent to the milling process, the concentrated solution preferably possesses certain properties and characteristics. Optical density measured for a 1.55 gram sample of the concentrated developer solution in 500 milliliters of a solvent such as Isopar ®G in a 1 millimeter cell using a densitometer in the transmission mode, such as a MacBeth TD 901 densitometer, preferably is from about 0.51 to about 0.56 optical density units. Preferably, the amount of solids present in the concentrated solution is from about 29.2 to about 30.2 percent by weight. The charge to mass ratio of the concentrated solution diluted with additional isoparaffinic hydrocarbon solvent to form a solution having an optical density of about $0.80\pm0.02$ optical density units may be from about 3.0 to about 10.0 microcoulombs per gram, and preferably is from about 4.0 to about 7.0 microcoulombs per gram. Conductance of the liquid developer, measured for a solution having an optical density of 0.8 optical density units, may be from about 95 to about 133 picomhos, which is equivalent to a specific conductivity of from about $1.50\times10^{-11}$ to about $2.10\times10^{-11}$(ohm-cm)$^{-1}$. Particle size of the solid components of the liquid developer may be from about 0.5 to about 4 microns, and a photomicrograph of the solid particles should indicate a shape that is spherical as opposed to irregular or jagged.

It is believed that the developer of the present invention is particularly suitable for use in medical imaging devices because of its extreme sensitivity, or low charge to mass ratio. Conventional electrophotographic developers typically have a charge to mass ratio of at least 1,400 or 1,500 microcoulombs per gram. Medical imaging devices such as that illustrated in the disclosure of U.S. Pat. No. 4,624,544, however, form images on a photoreceptor by the impingement of X-rays upon the imaging member to form a latent image, which latent image is subsequently developed and transferred to a suitable substrate. Since it is desirable to expose the patient to as little radiation as possible, the amount of X-ray radiation used to form the image is minimized to the extent possible without impairing the quality of images formed. An extremely sensitive developer composition having a small charge to mass ratio, such as the developer of the present invention, enables the production of high quality xeroradiographic images when amounts of radiation as small as 0.05 to 0.15 rads are used to create the latent image.

In addition, despite its unusually low charge to mass ratio, the developer of the present invention is especially formulated to be electrostatically transferrable. The toner particles retain a degree of adhesion to the photoreceptor and to each other that is sufficient to enable the formation of more than a single layer of particles on the latent image during development. This slight degree of agglomeration of the toner particles permits transfer without disruption of the image. The liquid developer of the present invention also allows successful transfer of high quality images while at the same time allowing the photoreceptor to be unharmed and easily cleanable for the next imaging cycle.

The advantages set forth above are believed to result primarily from the dual polymer system present in the liquid developer of the present invention. These polymer resins are believed to attach themselves to the pigment particles during the milling process by encapsulating each pigment particle with a coating of the two resins. At least three functions are performed by the polymeric resins. They provide a steric barrier between pigment particles that prevents flocculation, and thus provides a stabilizing force in the liquid developer. In addition, the vinyl toluene acrylic terpolymer resin component contains within its structure the charge controlling agent for the liquid developer, which eliminates the need to add a charge control additive to the developer liquid where it would exist largely in the continuous phase instead of being associated with the pigment particle. In addition, the ratios of the polymers to each other and to the pigment have been optimized to enable both successful transfer of a high quality image and ease in cleaning of the photoreceptor before the next imaging cycle.

Another aspect of the present invention resides in a method of imaging comprising: (a) providing a xeroradiographic imaging device containing a developer housing and a photoconductive imaging member; (b) placing in the developer housing the developer composition described herein; (c) forming latent images on the photoconductive imaging member; (d) developing the formed latent images with the developer composition from the developer housing; and (e) transferring the developed latent images to a suitable substrate. The xeroradiographic imaging device may be of any type suitable for the production of diagnostic medical images by creating latent images on a photoconductor via X-ray radiation that is passed through the subject matter of the image before reaching the photoconductor. An especially preferred device is the Xerox ®175 Medical Imaging System, commercially available from Xerox Medical Systems, Pasadena, CA. The Xerox ®175 is described in U.S. Pat. No. 4,624,544, the disclosure of which is totally incorported herein by reference, and is an automatic system for developing an image from a xerographic plate, which during exposure to X-rays and ambient light is enclosed in a cassette comprising a development station, an image transfer station, a cleaning station, a changing station, input-output means, and an elevator having, from bottom to top, a stack of stored plates; a first, second, third and fourth level, the fourth level having a means for heating said plate to remove residual images, wherein the above mentioned components are situated within the system in the order stated from one end of the system to the other, said input-output means further comprising, from top to bottom, an input station into which the cassette containing an exposed plate is inserted, an output station from which is discharged a charged plate enclosed within a cassette, and an image output station where the finished image on paper is delivered to the operator; and further comprising means for transporting said plate through the system, which also has levels corresponding to those of the elevator, to the various stations in the following order; from the input station to the first level of the elevator, to the third level, to the other end of the system, to the second level, to the development station, to the transfer station, to the cleaning station, to the elevator, to the fourth level, and then onto the top of the stored stack of plates.

After development, the image may be transferred to any suitable substrate capable of receiving images developed with a liquid developer, such as coated paper, uncoated paper, or transparency material. A particularly preferred substrate possesses a coating as disclosed in copending application U.S. Ser. No. 115,010, filed 10-29-87 "Process for Forming Electrophotographic Images on a Self-Fusing Substrate", inventor D. Paul Foote), the disclosure of which is totally incorporated herein by reference.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Preparation of a Concentrated Solution

To a three gallon ceramic jar, available from Paul Abbé Co., Little Falls, NJ, was added 3,710 milliliters of the high purity isoparaffinic hydrocarbon Isopar ®G, available from Exxon Co., Houston, TX, 847.9 grams of the acrylic copolymer resin Neocryl ®S-1004, available from Polyvinyl Chemical Industries, Wilmington, MA, 253.8 grams of the vinyl toluene acrylic terpolymer resin Pliolite ®OMS, manufactured by Goodyear Co., Akron, OH, 50 milliliters of a solution of 97 percent by weight Isopar ®G, and 3 percent by weight butylated hydroxytoluene (BHT), commercially available from McKesson Chemical Co., Los Angeles, CA as Shell Ionol CP, and 677.7 grams of a toned carbon black pigment commercially available as Black Toner BK 8595 from Paul Uhlich & Co., Hastings-on-Hudson, NY. Also included in the ceramic jar were 9,000 grams of burundum cylinders of one half inch height and one half inch diameter, commercially available from Diamonite Products Manufacturing, Inc., Shrieve, OH. The cylinder was tumbled on a rolling mill at a rate of 210 feet per minute for 60 hours.

EXAMPLE II

Optical Density Determination

After 60 hours of tumbling, 1.55 grams of the contents of the jar described in Example I were added to a clean glass quart jar on a top loading balance. To the jar was added 500 milliliters of Isopar ®G, after which the jar was closed and shaken well. A sample of this solution was then added to a 1 millimeter path length glass spectrophotometer cell, available from Markson Science, Inc., Del Mar, CA, and the cell was placed in a calibrated Transmission Densitometer, Model TD-901, available from Macbeth, Newburgh, NY. The optical density of this sample was found to be 0.51 optical density units.

EXAMPLE III

Determination of Solids Content

After 60 hours of tumbling, 1 gram (approximately 1.2 milliliters) of the contents of the jar described in Example I was placed in a clean, tared 50 milliliter beaker, after which the beaker and its contents were then placed in a Mettler HK 160 analytical balance and the mass determined. The beaker and its contents were then placed in a 60° C. drying oven for 3 days to evaporate all volatiles from the beaker, and a hard, non-pliable material remained. The beaker and its contents were then placed in the Mettler HK 160 analytical balance and the mass determined. By this process, the weight percentage of solid material in the developer was found to be 29.7 percent by weight.

EXAMPLE IV

Determination of Charge to Mass Ratio

After 60 hours of tumbling, 4.62 grams of the contents of the jar described in Example I were added to a clean glass jar, which was then filled with 950 milliliters of Isopar ®G. The jar was shaken well, and the optical density of the solution was determined to be 0.8 optical density units. After 45 minutes, the solution was added to a 1 liter stainless steel beaker adapted to accept electrical connection and tubing connection to a pump, available from American Scientific Products. The beaker was attached by Tigon Tubing, available from Norton Plastics and Synthetics Division, Akron, OH, to Pump Model Z-12500, available from Gormann Rupp Industries, Belleville, OH. The pump was turned on immediately, and the solution was allowed to circulate for 1 to 3 minutes. On the instrument, the electrometer range was set to $10^{-7}$ coulombs, fast mode, and the power supply was set to 500 volts with the instrument not yet being in operation mode. A fabricated cylindrical electrode made of stainless steel shim stock and having a diameter of 2.5 inches and a height of 3 inches was preweighed on a Mettler HK 160 analytical balance, and attached to the negative post on the lucite fabricated cap. The positive lead of the instrument was connected to the outside of the beaker and the electrometer was zeroed. The power supply and the electrometer were then switched to operate mode. After 2 minutes, the power supply was turned off and the electrode was removed and dried with a hot air gun, after which the electrode was reweighed to determine the amount of toner deposited on it during the electrodeposition process. Calculated according to the formula $$Q/M = \frac{\text{electrometer readout} \times 0.1}{\text{weight in grams of deposited toner}}$$

the charge to mass ratio (Q/M) was determined to be 4.3 microcoulombs per gram.

EXAMPLE V

Conductivity Determination

After 60 hours of tumbling, 1.55 grams of the contents of the jar described in Example I were added to a clean glass jar, which was then filled with Isopar ®G in an amount sufficient to provide a solution having an optical density of 0.80±0.01 optical density units as measured with a Macbeth TD-901 Transmission Densitometer. A 35 milliliter sample of the solution was placed in a liquid reference cell, Model 1730-3T, available from Rutherford Research, Rutherford, NJ, and the cell was connected to a Type 1615-A Capacitance Measuring Assembly consisting of a Type 16155 Capacitance Bridge, a Type 1311 Audio Oscillator, and a Type 1232 Tuned Amplifier and Null Detector, all of which are commercially available from GenRad, Inc., Concord, MA. The conductance of the solution was determined to be 105 picomhos, which is equivalent to a specific conductivity of $1.66\times10^{-11}$(ohm-cm)$^{-1}$.

EXAMPLE VI

Four additional concentrated solutions were prepared according to the method of Example I, and were tested for physical properties according to the methods of Examples II, IV, and V. The physical properties of these concentrated solutions appear in Table 1 below along with information regarding the milling process:

TABLE 1

| | Milling Time (hours) | Milling Speed (feet/min) | Charge to Mass Ratio (μC/g) | Conductivity (picomhos) | Optical Density |
|---|---|---|---|---|---|
| A | 60 | 205 | 5.3 | 95 | 0.51 |
| B | 62 | 210 | 4.1 | 100 | 0.53 |
| C | 60 | 210 | 4.3 | 105 | 0.51 |
| D | 62 | 210 | 4.7 | 95 | 0.52 |

EXAMPLE VII

Image Formation

A concentrated solution prepared according to the method of Example I is introduced into a Xerox ®175 Medical Imaging System. Isopar ®G and the concentrated solution are then combined in a ratio of 107 milliliters (94 grams) of the concentrated solution to 2 gallons, or 7,570 milliliters of the Isopar ®G, and xeroradiographic images of a lead star test pattern are formed and developed. Images developed with the developer of Example I are found to be of high quality and excellent resolution in that the line pairs are sharp and well defined.

Other embodiments and modifications of the present invention may occur to those skilled in the art subsequent to a review of the information presented herein; these embodiments and modifications, as well as equivalents thereof, are also included within the scope of this invention.

What is claimed is:

1. A xeroradiographic liquid developer composition comprising:

(a) a concentrated solution comprising i. an isoparaffinic hydrocarbon present in an amount of from about 60 to about 80 percent by weight;

ii. a pigment present in an amount of from about 10 to about 18 percent by weight;

iii. a first polymeric resin component comprising a vinyl toluene acrylic terpolymer resin present in an amount of from about 3 to about 7 percent by weight; and iv. a second polymeric resin component comprising an acrylic copolymer resin present in an amount of from about 5 to about 20 percent by weight; and (b) an additional amount of said isoparaffinic hydrocarbon sufficient to enable a developer solution which comprises from about 98.0 to about 99.5 percent by weight of isoparaffinic hydrocarbon, wherein said developer composition has a charge to mass ratio of from about 4 to about 7 microcoulombs per gram.

2. A developer composition in accordance with claim 1 which contains an antioxidant additive present in an amount of from about 0.01 to about 0.05 percent by weight of the concentrated solution.

3. A developer composition in accordance with claim 2 wherein the antioxidant additive is butylated hydroxytoluene.

4. A developer composition in accordance with claim 3 wherein the butylated hydroxytoluene is present in an amount of about 0.03 percent by weight of the concentrated solution.

5. A developer composition in accordance with claim 1 wherein the isoparaffinic hydrocarbon has a flash point of from about 38° C. to about 41° C.

6. A developer composition in accordance with claim 1 wherein the isoparaffinic hydrocarbon has a specific gravity of from about 0.74 to about 0.76 gram per milliliter.

7. A developer composition in accordance with claim 1 wherein the isoparaffinic hydrocarbon is Isopar ®G.

8. A developer composition in accordance with claim 1 wherein the pigment is a treated, molybdated carbon black having a dye adsorbed thereon.

9. A developer composition in accordance with claim 8 wherein the treated carbon black pigment is Black Toner BK 8595.

10. A developer composition in accordance with claim 1 wherein the first polymeric resin component has a conductivity of from about $1.58\times10^{-9}$ to about $3.16\times10^{-9}$(ohm-cm)$^{-1}$ when said conductivity is for a solution comprising about 10 percent by weight of the first polymeric resin component and about 90 percent by weight of an isoparaffinic hydrocarbon solvent.

11. A developer composition in accordance with claim 1 wherein the first polymeric resin component is present in an amount of about 5.5 percent by weight of the concentrated solution.

12. A developer composition in accordance with claim 11 wherein the first polymeric resin component is Pliolite ®OMS.

13. A developer composition in accordance with claim 1 wherein the second polymeric resin has a conductivity of about $1.03\times10^{-11}$(ohm-cm)$^{-1}$ when said conductivity is for a solution comprising about 10 percent by weight of the second polymeric resin component and about 90 percent by weight of an isoparaffinic hydrocarbon solvent.

14. A developer composition in accordance with claim 1 wherein the second polymeric resin component is present in an amount of about 9 percent by weight of the concentrated solution.

15. A developer composition in accordance with claim 14 wherein the second polymeric resin component is Neocryl ®S-1004.

16. A xeroradiographic liquid developer composition in accordance with claim 1 wherein said concentrated solution comprises an isoparaffinic hydrocarbon in an amount of about 70 percent by weight; a pigment present in an amount of about 15 percent by weight; a first polymeric resin component comprising a vinyl toluene acrylic terpolymer resin present in an amount of about 5.5 percent by weight; a second polymeric resin component comprising an acrylic copolymer resin present in an amount of about 9 percent by weight; butylated hydroxytoluene in an amount of about 0.03 percent by weight; and an additional amount of said isoparaffinic hydrocarbon sufficient to enable a developer solution which comprises about 99.5 percent by weight of isoparaffinic hydrocarbon.

17. A developer composition in accordance with claim 16 wherein the isoparaffinic hydrocarbon has a flash point of from about 38° C. to about 41° C. and a specific gravity of from about 0.74 to about 0.76 gram per milliliter; the pigment is a treated, molybdated carbon black having a dye adsorbed thereon; the first polymeric resin component has a conductivity of from about $1.58\times10^{-9}$ to about $3.16\times10^{-9}$(ohm-cm)$^{-1}$ when said conductivity is for a solution comprising about 10 percent by weight of the first polymeric resin and about 90 percent by weight of an isoparaffinic hydrocarbon; and the second polymeric resin component has a conductivity of from about $3.95\times10^{-12}$ to about $1.58\times10^{-11}$(ohm-cm)$^{-1}$ when said conductivity is for a solution comprising about 10 percent by weight of the second polymeric resin and about 90 percent by weight of an isoparaffinic hydrocarbon.

18. A developer composition in accordance with claim 16 wherein the isoparaffinic hydrocarbon is Isopar ®G, the pigment is Black Toner BK 8595, the first polymeric resin component is Pliolite ®OMS, and the second polymeric resin component is Neocryl ®S-1004.

19. A process for preparing a xeroradiographic liquid developer composition, comprising: (a) preparing a concentrated solution by i. introducing into a container tumbling media and a composition comprising:
   A. from about 60 to about 80 percent by weight of an isoparaffinic hydrocarbon;
   B. from about 10 to about 18 percent by weight of a pigment;
   C. from about 3 to about 7 percent by weight of a first polymeric resin component comprising a vinyl toluene acrylic terpolymer resin;
   D. from about 5 to about 20 percent by weight of a second polymeric resin component comprising an acrylic copolymer resin; and
   E. from about 0.01 to about 0.05 percent by weight of an antioxidant additive;
ii. placing said container on a rolling mill; and
iii. tumbling said container on said rolling mill at a rate of from about 180 to about 240 feet per minute for a period of from about 40 to about 65 hours; and (b) adding to the concentrated solution an additional amount of the isoparaffinic hydrocarbon sufficient to result in a developer solution comprising from about 98.0 to about 99.5 percent by weight of the isoparaffinic hydrocarbon, wherein the resulting developer composition has a charge to mass ratio of from about 4 to about 7 microcoulombs per gram.

20. A process in accordance with claim 19 wherein the isoparaffinic hydrocarbon has a flash point of from about 38° C. to about 41° C.

21. A process in accordance with claim 19 wherein the isoparaffinic hydrocarbon has a specific gravity of from about 0.74 to about 0.76 gram per milliliter.

22. A process in accordance with claim 19 wherein the isoparaffinic hydrocarbon is present in an amount of about 70 percent by weight of the concentrated solution.

23. A process in accordance with claim 19 wherein the pigment is a treated, molybdated carbon black having a dye adsorbed thereon.

24. A process in accordance with claim 19 wherein the pigment is present in an amount of about 15 percent by weight.

25. A process in accordance with claim 21 wherein the first polymeric resin has a conductivity of from about $1.58\times10^{-9}$ to about $3.16\times10^{-9}$(ohm-cm)$^{-1}$ when said conductivity is for a solution comprising about 10 percent by weight of the first polymeric resin and about 90 percent by weight of an isoparaffinic hydrocarbon solvent.

26. A process in accordance with claim 19 wherein the first polymeric resin component is present in an amount of about 5.5 percent by weight.

27. A process in accordance with claim 19 wherein the second polymeric resin has a conductivity of from about $3.95\times10^{-12}$ to about $1.58\times10^{-11}$(ohm-cm)$^{-1}$ when said conductivity is for a solution comprising about 10 percent by weight of the second polymeric resin and about 90 percent by weight of an isoparaffinic hydrocarbon solvent.

28. A process in accordance with claim 19 wherein the second polymeric resin component is present in an amount of about 9 percent by weight.

29. A process in accordance with claim 19 wherein the tumbling media comprise Burundum cylinders having dimensions of about one half inch height and one half inch diameter.

30. A process in accordance with claim 19 wherein the container is tumbled on the rolling mill at a rate of about 210 feet per minute.

31. A process in accordance with claim 19 wherein the isoparaffinic hydrocarbon is present in an amount of about 70 percent by weight of the concentrated solution, the pigment is present in an amount of about 15 percent by weight of the concentrated solution, the first polymeric resin component is present in an amount of about 5.5 percent by weight of the concentrated solution, and the second polymeric resin is present in an amount of about 9 percent by weight of the concentrated solution.

32. A process in accordance with claim 31 wherein the tumbling media are Burundum cylinders having dimensions of one half inch height and one half inch diameter; the isoparaffinic hydrocarbon has a flash point of from about 38° C. to about 41° C. and a specific gravity of from about 0.74 to about 0.76 gram per milliliter; the pigment is a treated, molybdated carbon black having a dye adsorbed thereon; the first polymeric resin component has a conductivity of from about $1.58\times10^{-9}$ to about $3.16\times10^{-9}$(ohm-cm)$^{-1}$ when said conductivity is for a solution comprising about 10 percent by weight of the first polymeric resin component and about 90 percent by weight of an isoparaffinic hydrocarbon solvent; the second polymeric resin component has a conductivity of from about $3.95\times10^{-12}$ to about $1.58\times10^{-11}$(ohm-cm)$^{-1}$ when said conductivity is for a solution comprising about 10 percent by weight of the second polymeric resin component and about 90 percent by weight of an isoparaffinic hydrocarbon solvent; and the container is tumbled on the rolling mill at a rate of about 210 feet per minute.

33. A liquid developer composition prepared in accordance with the method of claim 19 wherein the concentrated solution possesses an optical density of from about 0.51 to about 0.56 optical density units when measured in a 1 millimeter cell for a 1.55 gram sample of the concentrated solution in 500 milliliters of an isoparaffinic hydrocarbon solvent having a specific gravity of from about 0.74 to about 0.76 gram per milliliter and a flash point of from about 38° C. to about 41° C.

34. A liquid developer composition prepared in accordance with the method of claim 19 and characterized in that the weight percentage of solids present in the concentrated solution is from about 29.2 to about 30.2 percent by weight of the concentrated solution.

35. A liquid developer composition prepared in accordance with the method of claim 19 and characterized in that the charge to mass ratio of the developer composition is from about 3.0 to about 10.0 microcoulombs per gram.

36. A liquid developer composition prepared in accordance with the method of claim 19 and characterized in that the conductivity of the concentrated solution is from about $1.50\times10^{-11}$ to about $2.10\times10^{-11}$(ohm-cm)$^{-1}$ when said conductivity is for a solution of the composition in an isoparaffinic hydrocarbon solvent, which solution has an optical density of about 0.8 optical density units.

37. A liquid developer composition prepared in accordance with the method of claim 19 and characterized in that the size of solid particles present in the composition is from about 0.5 to about 4 microns.

38. A liquid developer composition prepared in accordance with the method of claim 32 and characterized in that the optical density of the concentrated solution is from about 0.51 to about 0.56 optical density units when measured in a 1 millimeter cell for a 1.55 gram sample of the concentrated solution in 500 milliliters of an isoparaffinic hydrocarbon solvent having a specific gravity of from about 0.74 to about 0.76 gram per milliliter and a flash point of from about 38° to about 41° C.; the weight percentage of solids present in the concentrated solution is from about 29.2 to about 30.2 percent by weight of the concentrated solution; the charge to mass ratio of the liquid developer composition is from about 3.0 to about 10.0 microcoulombs per gram when measured for a solution of the developer composition having an optical density of $0.80\pm0.02$ optical density units; the conductivity of the concentrated solution is from about $1.50\times10^{-11}$ to about $2.10\times10^{-11}$(ohm-cm)$^{-1}$ when said conductivity is for a solution of the composition in an isoparaffinic hydrocarbon solvent, which solution has an optical density of about 0.8 optical density units; and the desired range for the size of solid particles present is from about 0.5 to about 4 microns.

39. A xeroradiographic liquid developer composition consisting essentially of: (a) a concentrated solution comprising i. an isoparaffinic hydrocarbon present in an amount of from about 60 to about 80 percent by weight;
ii. a pigment present in an amount of from about 10 to about 18 percent by weight;
iii. a first polymeric resin component comprising a vinyl toluene acrylic terpolymer resin present in an amount of from about 3 to about 7 percent by weight; and
iv. a second polymeric resin component comprising an acrylic copolymer resin present in an amount of from about 5 to about 20 percent by weight; and (b) an additional amount of said isoparaffinic hydrocarbon sufficient to enable a developer solution which comprises from about 98.0 to about 99.5 percent by weight of isoparaffinic hydrocarbon, wherein said developer composition has a charge to mass ratio of from about 3 to about 10 microcoulombs per gram.

40. A developer composition in accordance with claim 39 wherein the isoparaffinic hydrocarbon is Isopar ®G.

41. A developer composition in accordance with claim 39 wherein the pigment is a treated, molybdated carbon black having a dye adsorbed thereon.

42. A developer composition in accordance with claim 41 wherein the treated carbon black pigment is Black Toner BK 8595.

43. A developer composition in accordance with claim 39 wherein the first polymeric resin is Pliolite-®OMS.

44. A developer composition in accordance with claim 39 wherein the second polymeric resin is Neocryl ®S-1004.

45. A developer composition in accordance with claim 39 wherein the first polymeric resin is Pliolite-®OMS and the second polymeric resin is Neocryl ®S-1004.

46. A developer composition in accordance with claim 39 wherein the first polymeric resin component is present in an amount of about 5.5 percent by weight of the concentrated solution.

47. A developer composition in accordance with claim 39 wherein the second polymeric resin component is present in an amount of about 9 percent by weight of the concentrated solution.

48. A xeroradiographic liquid developer composition in accordance with claim 39 wherein said concentrated solution comprises an isoparaffinic hydrocarbon in an amount of about 70 percent by weight; a pigment present in an amount of about 15 percent by weight; a first polymeric resin component comprising a vinyl toluene acrylic terpolymer resin present in an amount of about 5.5 percent by weight; a second polymeric resin component comprising an acrylic copolymer resin present in an amount of about 9 percent by weight; butylated hydroxytoluene in an amount of about 0.03 percent by weight; and an additional amount of said isoparaffinic hydrocarbon sufficient to enable a developer solution which comprises about 99.5 percent by weight of isoparaffinic hydrocarbon.

49. A developer composition in accordance with claim 48 wherein the isoparaffinic hydrocarbon has a flash point of from about 38° C. to about 41° C. and a specific gravity of from about 0.74 to about 0.76 gram per milliliter; the pigment is a treated, molybdated carbon black having a dye adsorbed thereon; the first polymeric resin component has a conductivity of from about $1.58\times10^{-9}$ to about $3.16\times10^{-9}$(ohm-cm)$^{-1}$ when said conductivity is for a solution comprising about 10 percent by weight of the first polymeric resin and about 90 percent by weight of an isoparaffinic hydrocarbon; and the second polymeric resin component has a conductivity of from about $3.95\times10^{-12}$ to about $1.58\times10^{-11}$(ohm-cm)$^{-1}$ when said conductivity is for a solution comprising about 10 percent by weight of the second polymeric resin and about 90 percent by weight of an isoparaffinic hydrocarbon.

50. A process for preparing a xeroradiographic liquid developer composition, comprising: (a) preparing a concentrated solution by i. introducing into a container tumbling media and a composition consisting essentially of:
   A. from about 60 to about 80 percent by weight of an isoparaffinic hydrocarbon;
   B. from about 10 to about 18 percent by weight of a pigment;
   C. from about 3 to about 7 percent by weight of a first polymeric resin component comprising a vinyl toluene acrylic terpolymer resin;
   D. from about 5 to about 20 percent by weight of a second polymeric resin component comprising an acrylic copolymer resin; and
   E. from about 0.01 to about 0.05 percent by weight of an antioxidant addditive;
ii. placing said container on a rolling mill; and
iii. tumbling said container on said rolling mill at a rate of from about 180 to about 240 feet per minute for a period of from about 40 to about 65 hours; and (b) adding to the concentrated solution an additional amount of the isoparaffinic hydrocarbon sufficient to result in a developer solution comprising from about 98.0 to about 99.5 percent by weight of the isoparaffinic hydrocarbon, wherein the resulting developer composition has a charge to mass ratio of from about 3 to about 10 microcoulombs per gram.

51. A process in accordance with claim 50 wherein the pigment is a treated, molybdated carbon black having a dye adsorbed thereon.

52. A process in accordance with claim 50 wherein the pigment is present in an amount of about 15 percent by weight.

53. A process in accordance with claim 50 wherein the first polymeric resin component is present in an amount of about 5.5 percent by weight.

54. A process in accordance with claim 50 wherein the first polymeric resin is Pliolite ®OMS.

55. A process in accordance with claim 50 wherein the second polymeric resin is Neocryl ®S-1004.

56. A process in accordance with claim 50 wherein the first polymeric resin is Pliolite ®OMS and the second polymeric resin is Neocryl ®S-1004.

57. A process in accordance with claim 50 wherein the second polymeric resin component is present in an amount of about 9 percent by weight.

58. A process in accordance with claim 50 wherein the isoparaffinic hydrocarbon is present in an amount of about 70 percent by weight of the concentrated solution, the pigment is present in an amount of about 15 percent by weight of the concentrated solution, the first polymeric resin component is present in an amount of about 5.5 percent by weight of the concentrated solution, and the second polymeric resin is present in an amount of about 9 percent by weight of the concentrated solution.

59. A liquid developer composition in accordance with claim 1 wherein said developer composition has a charge to mass ratio of from about 4 to about 7 microcoulombs per gram.

60. A process in accordance with claim 19 wherein the resulting developer composition has a charge to masss ratio of from about 4 to about 7 microcoulombs per gram.

61. A liquid developer composition in accordance with claim 39 wherein the charge to mass ratio of the developer composition is from about 4 to about 7 microcoulombs per gram.

62. A process in accordance with claim 50 wherein the resulting developer composition has a charge to mass ratio of from about 4 to about 7 microcoulombs per gram.

63. A xeroradiographic liquid developer composition comprising: (a) a concentrated solution comprising i. an isoparaffinic hydrocarbon present in an amount of from about 60 to about 80 percent by weight;
ii. a pigment present in an amount of from about 10 to about 18 percent by weight;
iii. a first polymeric resin component comprising a vinyl toluene acrylic terpolymer resin present in an amount of from about 3 to about 7 percent by weight; and
iv. a second polymeric resin component comprising an acrylic copolymer resin present in an amount of from about 5 to about 20 percent by weight; and (b) an additional amount of said isoparaffinic hydrocarbon sufficient to enable a developer solution which comprises from about 98.0 to about 99.5 percent by weight of isoparaffinic hydrocarbon, wherein said first polymeric resin is Pliolite ®OMS and said second polymeric resin is Neocryl ®S-1004, and wherein said developer composition has a charge to mass ratio of from about 3 to about 10 microcoulombs per gram.

64. A process in accordance with claim 63 wherein the resulting developer composition has a charge to mass ratio of from about 4 to about 7 microcoulombs per gram.

65. A process for preparing a xeroradiographic liquid developer composition, comprising: (a) preparing a concentrated solution by i. introducing into a container tumbling media and a composition comprising:

A. from about 60 to about 80 percent by weight of an isoparaffinic hydrocarbon;

B. from about 10 to about 18 percent by weight of a pigment;

C. from about 3 to about 7 percent by weight of a first polymeric resin component comprising a vinyl toluene acrylic terpolymer resin;

D. from about 5 to about 20 percent by weight of a second polymeric resin component comprising an acrylic copolymer resin; and E. from about 0.01 to about 0.05 percent by weight of an antioxidant additive;

ii. placing said container on a rolling mill; and iii. tumbling said container on said rolling mill at a rate of from about 180 to about 240 feet per minute for a period of from about 40 to about 65 hours; and (b) adding to the concentrated solution an additional amount of the isoparaffinic hydrocarbon sufficient to result in a developer solution comprising from about 98.0 to about 99.5 percent by weight of the isoparaffinic hydrocarbon, wherein the first polymeric resin component is Pliolite ®OMS and the second polymeric resin component is Neocryl ®S-1004, and wherein the resulting developer composition has a charge to mass ratio of from about 3 to about 10 microcoulombs per gram.

66. A process in accordance with claim 65 wherein the resulting developer composition has a charge to mass ratio of from about 4 to about 7 microcoulombs per gram.

67. A developer composition in accordance with claim 1 wherein the first polymeric resin component is Pliolite ®OMS and the second polymeric resin component is Neocryl ®S-1004.

68. A process in accordance with claim 19 wherein the first polymeric resin component is Pliolite ®OMS and the second polymeric resin component is Neocryl ®S-1004.

* * * * *